US011412911B2

(12) United States Patent
Reunanen

(10) Patent No.: US 11,412,911 B2
(45) Date of Patent: Aug. 16, 2022

(54) DISHWASHER

(71) Applicant: ELECTROLUX APPLIANCES AKTIEBOLAG, Stockholm (SE)

(72) Inventor: Kristian Reunanen, Stockholm (SE)

(73) Assignee: Electrolux Appliances Aktiebolag

( * ) Notice: Subject to any disclaimer, the term of this patent is extended or adjusted under 35 U.S.C. 154(b) by 0 days.

(21) Appl. No.: 17/253,655

(22) PCT Filed: Jun. 26, 2018

(86) PCT No.: PCT/EP2018/067037
§ 371 (c)(1),
(2) Date: Dec. 18, 2020

(87) PCT Pub. No.: WO2020/001741
PCT Pub. Date: Jan. 2, 2020

(65) Prior Publication Data
US 2021/0259508 A1 Aug. 26, 2021

(51) Int. Cl.
*A47L 15/16* (2006.01)
*A47L 15/44* (2006.01)
*A47L 15/50* (2006.01)

(52) U.S. Cl.
CPC ..... *A47L 15/16* (2013.01); *A47L 15/44* (2013.01); *A47L 15/508* (2013.01)

(58) Field of Classification Search
None
See application file for complete search history.

(56) References Cited

U.S. PATENT DOCUMENTS

| | | | |
|---|---|---|---|
| 4,735,228 | A | 4/1988 | Boedecker et al. |
| 5,186,912 | A | 2/1993 | Steindorf et al. |
| 6,622,896 | B2 | 9/2003 | Hegeman et al. |
| 6,773,668 | B1 | 8/2004 | Everson et al. |
| 7,275,552 | B2 | 10/2007 | DeWeerd et al. |
| 7,475,696 | B2 | 1/2009 | Vanderroest et al. |
| 8,608,866 | B2 | 12/2013 | Francisco et al. |
| 9,034,114 | B2 | 5/2015 | Bertsch et al. |
| 9,392,924 | B2 | 7/2016 | Bertsch et al. |
| 9,861,257 | B2 | 1/2018 | Durham et al. |
| 10,117,561 | B2 | 11/2018 | Kan et al. |
| 10,413,153 | B2 | 9/2019 | Detko |
| 2005/0045672 | A1 | 3/2005 | Marone |

(Continued)

FOREIGN PATENT DOCUMENTS

| | | | |
|---|---|---|---|
| CN | 107616772 | A | 1/2018 |
| CN | 110693416 | A | 1/2020 |

(Continued)

OTHER PUBLICATIONS

International Search Report for PCT/EP2018/067037 (ISA/EP) dated Sep. 24, 2018 (3 pages).

(Continued)

*Primary Examiner* — Levon J Shahinian
(74) *Attorney, Agent, or Firm* — RatnerPrestia

(57) ABSTRACT

A dishwasher is disclosed that may include a washing chamber and a detergent compartment. The detergent compartment may include an opening facing the washing chamber. The dishwasher may further include two or more static nozzle openings arranged in the washing chamber. Each of the two or more static nozzle openings may be configured to spray water into the detergent compartment, via the opening, during operation of the dishwasher.

31 Claims, 4 Drawing Sheets

(56) References Cited

U.S. PATENT DOCUMENTS

| | | | |
|---|---|---|---|
| 2005/0126607 | A1 | 6/2005 | Haft et al. |
| 2009/0119849 | A1 | 5/2009 | Hill et al. |
| 2018/0171530 | A1 | 6/2018 | Hendrickson et al. |
| 2018/0344126 | A1 | 12/2018 | Minde et al. |
| 2020/0237179 | A1 | 7/2020 | Haegermarck et al. |

FOREIGN PATENT DOCUMENTS

| | | | |
|---|---|---|---|
| EP | 1929920 | A1 | 6/2008 |
| EP | 1849907 | B1 | 7/2008 |
| EP | 2138088 | A1 | 12/2009 |
| EP | 1703012 | B1 | 12/2013 |
| EP | 2240065 | B1 | 9/2015 |
| EP | 2923627 | A1 | 9/2015 |
| EP | 2404538 | B1 | 8/2019 |
| EP | 3598931 | A1 | 1/2020 |
| GB | 1521760 | A | 8/1978 |
| GB | 2321590 | B | 11/2000 |
| JP | 3736194 | B2 | 1/2006 |
| JP | 4675287 | B2 | 4/2011 |
| KR | 19980033950 | U | 9/1998 |
| WO | WO-2006/069827 | A1 | 7/2006 |
| WO | WO-2016/075644 | A1 | 4/2016 |
| WO | WO-2017/036513 | A1 | 3/2017 |
| WO | WO-2018/036630 | A1 | 3/2018 |
| WO | WO-2018/099671 | A1 | 6/2018 |
| WO | WO-2019/156503 | A1 | 8/2019 |
| WO | WO-2020/126044 | A1 | 6/2020 |

OTHER PUBLICATIONS

Written Opinion for PCT/EP2018/067037 (ISA/EP) dated Sep. 24, 2018 (6 pages).

DISHWASHER

CROSS-REFERENCE TO RELATED APPLICATIONS

This application is a national stage application filed under 35 U.S.C. § 371 of International Application No. PCT/EP2018/067037 filed Jun. 26, 2018, which application is hereby incorporated by reference in its entirety.

TECHNICAL FIELD

The present disclosure relates to a dishwasher comprising a detergent compartment.

BACKGROUND

A dishwasher is an apparatus for washing items such as dishware and cutlery. A dishwasher comprises a washing chamber where the items to be washed are positioned, usually in racks. One or more spray arrangements of the dishwasher spray washing liquid onto the items to clean them. The washing liquid is collected in a sump at a bottom of the washing chamber. A circulation pump of the dishwasher is fluidly connected to the sump and pumps washing liquid from the sump to the one or more spray arrangements during a wash cycle. In order to improve the cleaning efficiency and the final cleaning result, the washing liquid is heated, typically to a temperature between 45 and 75° C., by one or more heating elements of the dishwasher.

A dishwasher comprises a detergent compartment arranged to be filled with detergent by a user. The detergent may be in liquid form or in solid form. Examples of detergents in solid form are detergent powder and detergent tablets. Detergent tablets provide several advantages over the other alternatives, for example, they can provide a correct amount of detergent and are simple to use. Detergent tablets constitute approximately 80% of the market and are thus most often used by users. However, some users prefer to use detergent powder and some users prefer to use detergent in liquid form, which put requirements on the design of the detergent compartment and on the dishwasher.

Solid detergent, such as detergent powder and detergent tablets, must be dissolved in water, preferably in the beginning of a wash cycle. Some dishwashers comprise one or more rotatable spray arms arranged to spray washing liquid in the washing compartment. Usually, nozzles of one or more of these rotatable spray arms are arranged such that water sprayed therefrom is intended to periodically reach the detergent compartment to dissolve the detergent therein. However, such solutions are associated with some problems and drawbacks. For example, in cases where detergent tablets are used, the detergent tablet may fall out of the detergent compartment into a sump of the washing chamber, or into a rack of the dishwasher. In both cases, the time needed to dissolve the tablet is highly random and for example depends on the position of the tablet within the washing chamber, i.e. if the tablet reaches a position in the washing chamber where water from the spray arms can reach the tablet. In some cases, the detergent may not be completely dissolved, and in other cases the detergent may be dissolved only towards the end of a wash cycle. In both such types of cases, the washing result may be significantly reduced.

As another example, in cases where a liquid detergent is used, the liquid detergent may flow out of the detergent compartment when filled, which is annoying for the user, and may lead to a greasy wall of a door of the dishwasher. Furthermore, over time, residues from detergent may stick onto surfaces of the detergent compartment, which impairs the impression of the dishwasher and may impair the function of the dishwasher.

SUMMARY

It is an object of the present invention to overcome, or at least alleviate, at least some of the above-mentioned problems and drawbacks.

According to an aspect of the invention, the object is achieved by a dishwasher comprising a washing chamber, and a detergent compartment comprising an opening facing the washing chamber. The dishwasher further comprises two or more static nozzle openings arranged in the washing chamber, wherein each of the two or more static nozzle openings is configured to spray water into the detergent compartment, via the opening, during operation of the dishwasher.

Since the dishwasher comprises two or more static nozzle openings configured to spray water into the detergent compartment during operation of the dishwasher, a more efficient, quick, and predictable dissolution of the detergent in the detergent compartment is provided. That is, since the dishwasher comprises two or more static nozzle openings, the dissolution of the detergent in the detergent compartment is not dependent on arrangements, such as rotating spray arms, which for example may become stuck in the washing chamber for example by objects hindering rotation of the spray arms. As a result, a dishwasher is provided in which a more predictable and reliable dissolution of the detergent is provided.

Furthermore, because the detergent is dissolved in a quicker manner, it can be ensured that the detergent is dissolved before water in the dishwasher reaches a peak temperature. Moreover, it can be ensured that detergent in the detergent compartment is completely dissolved also in shorter washing programmes of the dishwasher. As a further result, because the detergent is dissolved in a more efficient, quick, and reliable manner the washing result can be improved.

Moreover, because the dishwasher comprises the two or more static nozzle openings configured to spray water into the detergent compartment during operation of the dishwasher, the occurrence of detergent residues in the detergent compartment can be reduced. Thereby, the visual impression of the dishwasher can be maintained over time and the functionality of the dishwasher can be maintained over time.

In addition, since the dishwasher comprises two or more static nozzle openings configured to spray water into the detergent compartment, instead of one, the detergent is dissolved in a quicker and more efficient manner. Furthermore, the risk that undissolved detergent is displaced out of the detergent compartment is reduced. This because liquid jets from the two or more static nozzle openings may hit a greater surface area of the detergent in the detergent compartment.

Accordingly, a dishwasher is provided overcoming, or at least alleviating, at least some of the above-mentioned problems and drawbacks. As a result, the above-mentioned object is achieved.

Optionally, the opening is located at an upper portion of the detergent compartment. Thereby, the risk that undissolved detergent falls out of the detergent compartment is reduced. Furthermore, the risk that undissolved detergent is displaced out of the detergent compartment by liquid jets of the two or more static nozzle openings is reduced. As further results thereof, a more predictable and reliable dissolution of the detergent is provided.

Optionally, the two or more static nozzle openings are arranged on a wall of the washing chamber. Thereby, a simple and reliable arrangement for feeding water to the two or more static nozzle openings can be provided. Furthermore, the space available in the washing chamber can be utilized in an efficient manner.

Optionally, the wall is a roof of the washing chamber. Thereby, a simple and reliable arrangement for feeding water to the two or more static nozzle openings can be provided. Furthermore, the space available in the washing chamber can be utilized in an efficient manner.

Optionally, the dishwasher comprises an upper spray arm and an upper hydraulic conduit arranged to feed water to the upper spray arm, and wherein the two or more static nozzle openings are fluidly connected to the upper hydraulic conduit. Thereby, a simple and reliable arrangement for feeding water to the two or more static nozzle openings is provided.

Furthermore, the space available in the washing chamber can be utilized in an efficient manner.

Optionally, the dishwasher comprises a rack for accommodating items to be washed in the washing chamber, and wherein the two or more static nozzle openings are arranged on the rack. Thereby, the space available in the washing chamber can be utilized in an efficient manner. Furthermore, a short distance can be provided between the two or more static nozzle openings and the opening of the detergent compartment.

Optionally, at least two of the two or more static nozzle openings are arranged such that liquid jets from the at least two static nozzle openings cross each other's paths between the at least two static nozzle openings and the detergent compartment. Thereby, the liquid jets may hit a greater surface area of the detergent in the detergent compartment and may hit in a manner causing a quicker dissolution of the detergent. As a further result thereof, the risk that undissolved detergent is displaced out of the detergent compartment can be further reduced.

Optionally, the two or more static nozzle openings are arranged in one static nozzle unit. Thereby, a simple and reliable arrangement for feeding water to the two or more static nozzle openings can be provided. Furthermore, the dishwasher can be manufactured and assembled in a more cost-efficient manner.

Optionally, the dishwasher comprises a door arranged to provide a closure of the washing chamber, and wherein the detergent compartment is arranged on an upper portion of the door. Thereby, an ergonomic and user-friendly dishwasher is provided. This because the detergent compartment can be filled when the door in a substantial upright position allowing a user to fill the detergent compartment without having to bend down.

Optionally, the detergent compartment is displaceable between an open position and a closed position, and wherein the opening is formed at an upper portion of the detergent compartment by a displacement of the detergent compartment towards the open position. Thereby, a dishwasher is provided in which detergent can be securely accommodated in the detergent compartment when the detergent compartment is in the closed position, as well as when the detergent compartment is in the open position. As a further result thereof, the risk that undissolved detergent falls out of the detergent compartment is further reduced. Furthermore, the risk that undissolved detergent is displaced out of the detergent compartment is further reduced.

Optionally, the detergent compartment comprises a lid displaceable between an open position and a closed position, and wherein the opening is formed at an upper portion of the detergent compartment by a displacement of the lid towards the open position. Thereby, a dishwasher is provided in which detergent can be securely accommodated in the detergent compartment when the lid is in the closed position, as well as when the lid is in the open position. As a further result thereof, the risk that undissolved detergent falls out of the detergent compartment is further reduced. Furthermore, the risk that undissolved detergent is displaced out of the detergent compartment is further reduced.

Optionally, the detergent compartment comprises a detergent outlet connected to a lower portion of the detergent compartment. Thereby, dissolved detergent can flow out of the detergent compartment in a controlled manner.

Optionally, the dishwasher comprises a siphon with an inlet connected to the lower portion of the detergent compartment and an outlet connected to the detergent outlet. Thereby, a detergent compartment is provided which requires a certain fill level before liquid starts to flow out of the detergent outlet. As a result, a user may fill the detergent compartment with liquid detergent, or with powder detergent, without the detergent flowing out of the detergent compartment. Furthermore, since the detergent compartment requires a certain fill level before liquid starts to flow out of the detergent outlet, detergent in the detergent compartment can be dissolved in a more efficient, quick, and reliable manner. This because when water is sprayed from the two or more static nozzle openings into the detergent compartment, a turbulent flow of water may surround the detergent.

Optionally, the dishwasher further comprises a rinse aid compartment comprising a rinse aid outlet for delivering rinse aid into the washing chamber, and wherein the detergent outlet and the rinse aid outlet are arranged in a shared liquid conducting path. Since the dishwasher comprises the two or more static nozzle openings configured to spray water into the detergent compartment during operation of the dishwasher, and since, according to these embodiments, the detergent outlet and the rinse aid outlet are arranged in a shared liquid conducting path, a more efficient, quick, and predictable delivering of rinse aid is provided into the washing chamber. As a further result thereof, the final wash result can be further improved.

Optionally, the rinse aid outlet is arranged downstream of the detergent outlet in the shared liquid conducting path. Thereby, water flowing out from the detergent outlet will flow over the rinse aid outlet. As further results thereof, an even more efficient, quick, and predictable delivering of rinse aid is provided into the washing chamber. Moreover, the risk of a clogged rinse aid outlet is reduced.

Further features of, and advantages with, the present invention will become apparent when studying the appended claims and the following detailed description.

BRIEF DESCRIPTION OF THE DRAWINGS

Various aspects of the invention, including its particular features and advantages, will be readily understood from the example embodiments discussed in the following detailed description and the accompanying drawings, in which.

DETAILED DESCRIPTION

Aspects of the present invention will now be described more fully. Like numbers refer to like elements throughout. Well-known functions or constructions will not necessarily be described in detail for brevity and/or clarity.

Figure 1:
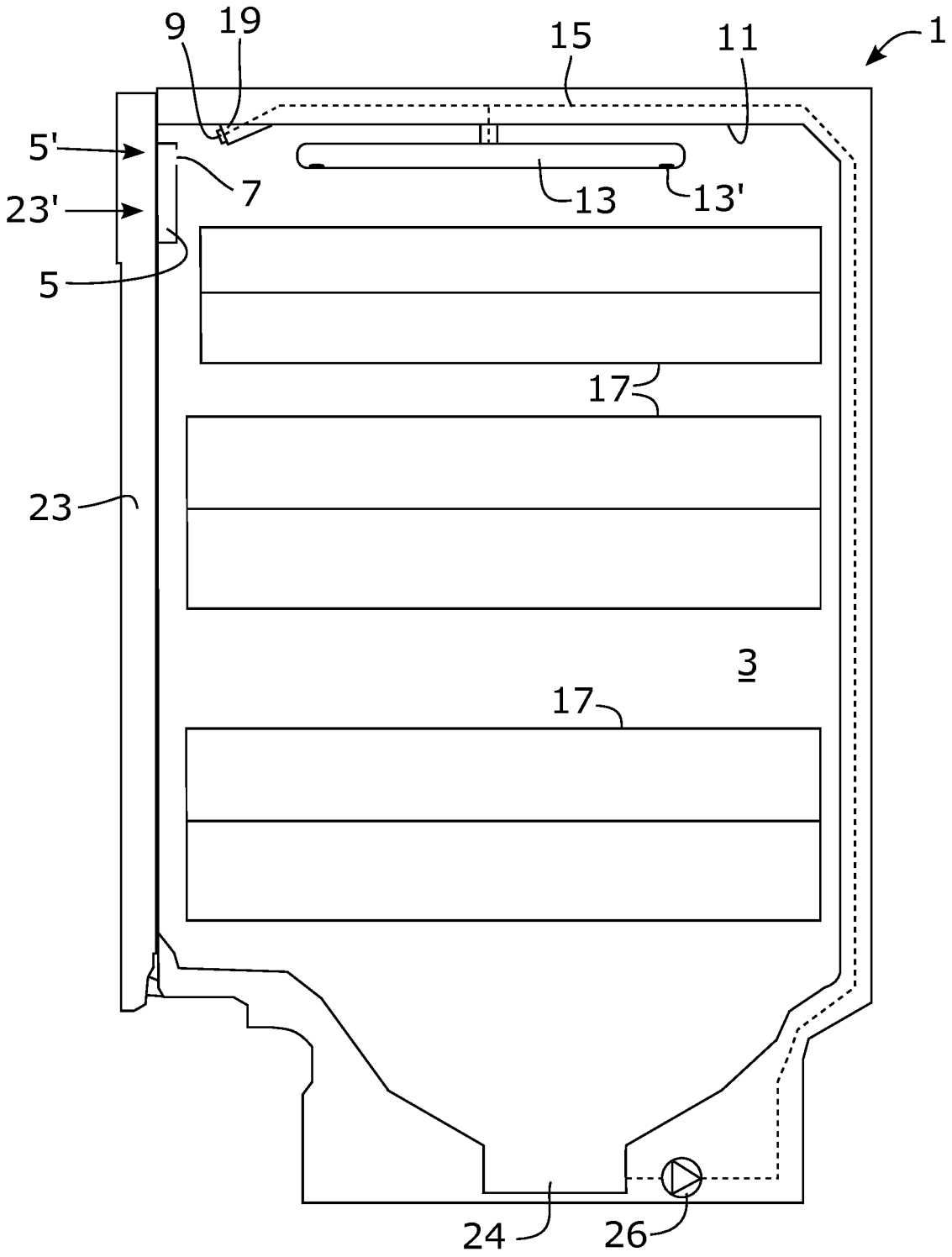
FIG. 1 schematically illustrates a dishwasher, according to some embodiments, FIG. 2 schematically illustrates a dishwasher, according to some further embodiments, FIG. 3 schematically illustrates a static nozzle unit of a dishwasher according to the embodiments illustrated in FIG. 1 and FIG. 2, FIG. 4 schematically illustrates a detergent compartment according to some further embodiments of the present disclosure, FIG. 5 schematically illustrates the detergent compartment, illustrated in FIG. 4, in an open position, FIG. 6 schematically illustrates a detergent compartment according to some further embodiments of the present disclosure, FIG. 7 schematically illustrates the detergent compartment, illustrated in FIG. 6, with a lid of the detergent compartment in an open position, and FIG. 8 schematically illustrates a front view a detergent compartment, according to some embodiments.

FIG. 1 schematically illustrates a dishwasher 1, according to some embodiments. The dishwasher 1 comprises a washing chamber 3, a set of racks 17, and a spray arm 13 arranged in the washing chamber 3. The dishwasher 1 further comprises a door 23 displaceable between an open position and a closed position. In FIG. 1, the door 23 is illustrated in the closed position. In the closed position the door 23 provides a closure of the washing chamber 3. In the open position, the door 23 provides access the washing chamber 3. The racks 17 are configured to accommodate items to be washed, such as dishware and cutlery. The dishwasher 1 further comprises a sump 24 at a lower portion of the washing chamber 3 and a circulation pump 26 fluidly connected to the sump 24. The dishwasher 1 further comprises hydraulic conduits 15 fluidly connecting the circulation pump 26 to the spray arm 13. During a wash cycle, the door 23 is in the closed position, and the circulation pump 26 pumps washing liquid, i.e. a mixture of water and detergent, from the sump 24 to the one or more spray arms 13. The spray arm 13 comprises nozzles 13' from which the washing liquid is sprayed onto items in the racks 13. In this manner, the items are cleaned. Due to gravity, the washing liquid is collected in the sump 24 where it is pumped again by the circulation pump 26 to the spray arm 13. The dishwasher 1 may comprise another number of spray arms 13, or spray arrangements, than depicted in FIG. 1

The dishwasher 1 further comprises a detergent compartment 5. The detergent compartment 1 is configured to be filled with detergent by a user prior to a wash cycle. According to the embodiments illustrated in FIG. 1, the detergent compartment 5 is arranged on an upper portion 23' of the door 23, which, as is further explained herein, facilitates the process of filling the detergent compartment 5. The detergent compartment 5 comprises an opening 7 facing the washing chamber 3. The dishwasher 1 further comprises two or more static nozzle openings 9 arranged in the washing chamber 3. Each of the two or more static nozzle openings 9 is configured to spray water into the detergent compartment 5, via the opening 7, during operation of the dishwasher 1. In this manner several advantages are obtained such as a more efficient, quick, and predictable dissolution of the detergent in the detergent compartment 5. That is, when water is sprayed from the two or more static nozzle openings 9 into the detergent compartment 5, via the opening 7, detergent in the detergent compartment 5 will dissolve in a more efficient, quick, and predictable manner.

As is further explained herein, the detergent compartment 5 may comprise a detergent outlet through which the dissolved detergent can flow out from the detergent compartment 5. As an alternative, or in addition, the dissolved detergent may flow out from the detergent compartment 5 through the opening 7. Due to gravity, the dissolved detergent and the water sprayed from the two or more static nozzle openings 9 is collected in the sump 24 of the dishwasher 1. According to the illustrated embodiments, this liquid is then pumped from the sump 24 by the circulation pump 26 to the two or more static nozzle openings 9 from which it is sprayed again into the detergent compartment 5, via the opening 7. Thus, even though the term "water" is used herein, in some cases, and/or in some periods of a wash cycle, the two or more static nozzle openings 9 may be configured to spray a mixture of water and detergent into the detergent compartment 5, via the opening 7.

According to the embodiments illustrated in FIG. 1, the opening 7 is located at an upper portion 5' of the detergent compartment 5, which prevents undissolved detergent from being displaced out of the detergent compartment 5. Furthermore, according to the embodiments illustrated in FIG. 1, the opening 7 is open and faces the washing chamber 3 when the detergent compartment 5 is in a closed position. That is, according to the embodiments illustrated in FIG. 1, the detergent compartment 5 is displaceable between an open position and a closed position. In FIG. 1, the detergent compartment 5 is illustrated in the closed position. In the open position, the detergent compartment 5 provides a filling opening through which a user can fill detergent into the detergent compartment 5. A user may thus open the door 23 of the dishwasher 1 and displace the detergent compartment 5 to the open position and fill the detergent compartment 5 with detergent through the filling opening. The user may then displace the detergent compartment 5 to the closed position and close the door 23 of the dishwasher. Since the detergent compartment 5 is arranged on an upper portion 23' of the door 23, the user can fill the detergent compartment 5 when the door 23 is in a relative upright position, such as when the door is in a position where an angle between the door 23 and a horizontal plane is within the range of 50 to 87 degrees. In this manner, the user can fill the detergent compartment 5 without having to bend down. Moreover, since the opening 7 is open and faces the washing chamber 3 when the detergent compartment 5 is in the closed position according to the embodiments illustrated in FIG. 1, the need for an electronically controlled opener of the detergent compartment 5 is circumvented.

The upper portion 23' of the door 23 may herein be defined as a portion of the door 23 above 70% of a height of the door 23, measured in a direction coinciding with a direction of the gravitational field at the location of the dishwasher 1, when the door 23 is in the closed position and when the dishwasher is positioned in an upright use position.

The upper portion 5' of the detergent compartment 5 may herein be defined as a portion of the detergent compartment 5 above 70% of a height of the detergent compartment 5, measured in a direction coinciding with a direction of the gravitational field at the location of the dishwasher 1, when the door 23 is in the closed position and when the dishwasher is positioned in an upright use position.

According to the embodiments illustrated in FIG. 1, the two or more static nozzle openings 9 are arranged on a wall 11 of the washing chamber 3, which, according to the illustrated embodiments, is a roof of the washing chamber 3.

In this manner, a relative short distance can be provided between the two or more static nozzle openings 9 and the opening 7 of the detergent compartment 5. Furthermore, the dishwasher 1 comprises an upper spray arm 13 and an upper hydraulic conduit 15 arranged to feed water to the upper spray arm 13. According to the illustrated embodiments, the two or more static nozzle openings 9 are fluidly connected to the upper hydraulic conduit 15. Thus, since the or more static nozzle openings 9 are arranged on the roof 11 of the washing chamber 3, the liquid supply to the two or more static nozzle openings 9 can be provided in a simple and cost-efficient manner.

According to the illustrated embodiments, the two or more static nozzle openings 9 are arranged in one static nozzle unit 19. In this manner, the hydraulic connection to the two or more static nozzle openings 9 can be provided in a simple and cost-efficient manner.

Figure 2:
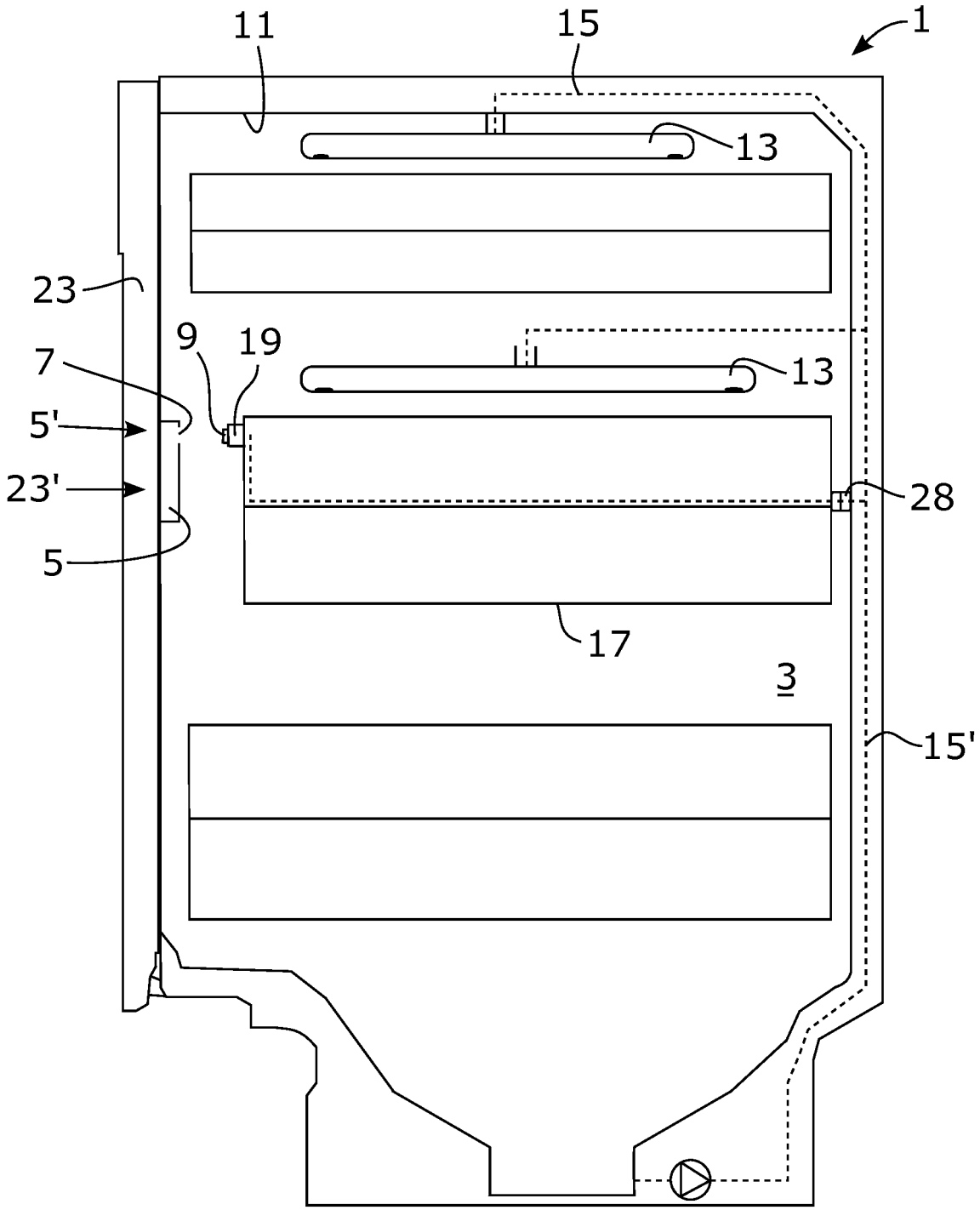

FIG. 2 schematically illustrates a dishwasher 1, according to some further embodiments. The dishwasher 1 according to the embodiments illustrated in FIG. 2 comprises the same features, functions, and advantages as the dishwasher 1 illustrated in FIG. 1, with some exceptions, explained below.

According to the embodiments illustrated in FIG. 2, the two or more static nozzle openings 9 are arranged on a rack 17 configured to accommodate items to be washed in the washing chamber 3. The two or more static nozzle openings 9 are arranged on a side of the rack 17 facing the door 25. In this manner, a short distance can be provided between the two or more static nozzle openings 9 and the opening 7 of the detergent compartment 5. Furthermore, according to the illustrated embodiments, the two or more static nozzle openings 9 are fluidly connected to a hydraulic conduit 15' arranged to conduct liquid to spray arms 13 of the dishwasher 1. Moreover, the dishwasher 1 comprises a hydraulic coupling 28 in an interface between the rack 17 and a back wall of the washing chamber 3. The hydraulic coupling 28 is arranged to disconnect when the rack 17 is displaced out of the washing chamber 3 and is arranged to connect when the rack 17 is displaced into the washing chamber 3.

Figure 3:
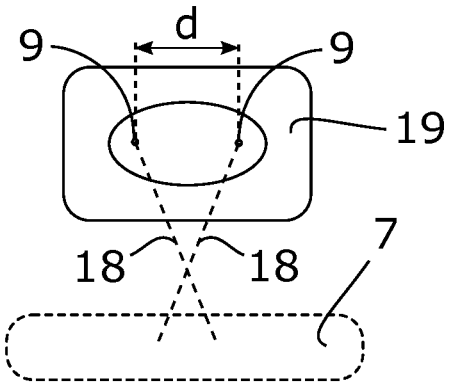

FIG. 3 schematically illustrates the static nozzle unit 19 according to the embodiments illustrated in FIG. 1 and FIG. 2. Below, simultaneous reference is made to FIG. 1-FIG. 3. According to these embodiments, the static nozzle unit 19 comprises two static nozzle openings 9. Thus, according to the embodiments illustrated in FIG. 1 and FIG. 2, the dishwasher 1 comprises two static nozzle openings 9 configured to spray water into the detergent compartment 5, via the opening 7, during operation of the dishwasher 1. The dishwasher 1 may comprise another number of static nozzle openings 9 than two, such as three, four, five or six. The static nozzle openings 9 are arranged at a distance d from each other. According to the embodiments illustrated in FIG. 3, the distance d is a horizontal distance. According to some embodiments, the distance d between the static nozzle openings 9 may be within the range of 2.5 mm to 9 cm, such as within the range of 3 mm to 3 cm.

In FIG. 3, the opening 7 of the detergent compartment 5 is schematically illustrated in dashed lines. As can be seen in FIG. 3, according to the illustrated embodiments, the nozzle openings 9 are arranged such that liquid jets 18 from the at least two static nozzle openings 9 cross each other's paths between the at least two static nozzle openings 9 and the detergent compartment 5. In this manner, the liquid from the static nozzle openings 9 will hit a greater surface area of the detergent in the detergent compartment 5. Thereby, the detergent is dissolved in a quicker manner, and the detergent is more securely accommodated in the detergent compartment 5. The term "static" is herein intended to encompass a detail that is substantially stationary during operation of the dishwasher 1, i.e. a detail which is not intended to be moved during operation of the dishwasher 1.

Figure 4:
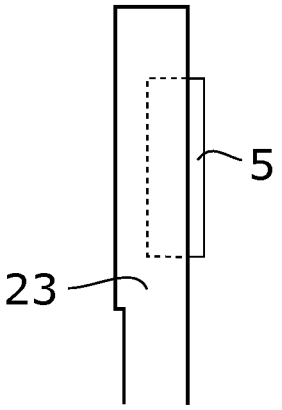

FIG. 4 schematically illustrates a detergent compartment 5 according to some further embodiments of the present disclosure. The detergent compartment 5 is displaceably arranged at a portion of a door 23 of a dishwasher between an open position and a closed position. In FIG. 4, the detergent compartment 5 is illustrated in the closed position.

Figure 5:
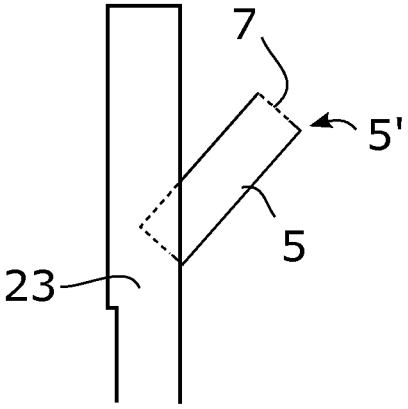

FIG. 5 schematically illustrates the detergent compartment 5, illustrated in FIG. 4, in an open position. As can be seen in FIG. 5, according to these embodiments, the opening 7 is formed at an upper portion 5' of the detergent compartment 5 by a displacement of the detergent compartment 5 towards the open position. That is, according to these embodiments, the opening 7 of the detergent compartment 5 is uncovered when the detergent compartment 5 is displaced to the open position. The dishwasher may comprise an electronically controlled latch which may control the detergent compartment 5 to the open position in the beginning of a wash cycle. Furthermore, as can be seen in FIG. 5, the opening 7 is arranged such that it allows a flow of water from the two or more static nozzle openings through the opening 7 while it prevents a release of undissolved detergent out of the detergent compartment 5.

Figure 6:
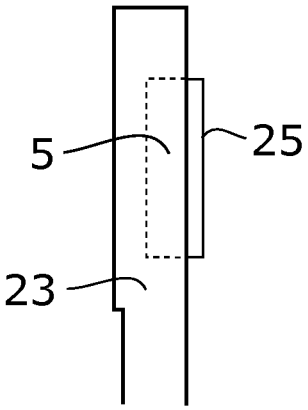

FIG. 6 schematically illustrates a detergent compartment 5 according to some further embodiments of the present disclosure. According to these embodiments, the detergent compartment 5 comprises a lid 25 displaceable between an open position and a closed position. In FIG. 6, the lid 25 is illustrated in the closed position.

Figure 7:
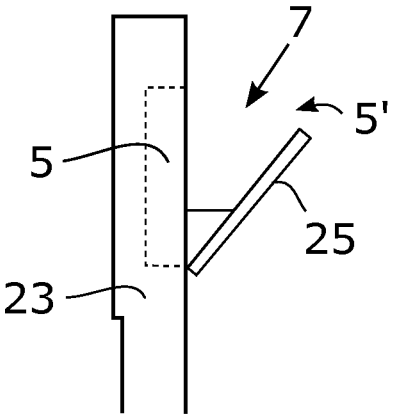

FIG. 7 schematically illustrates the detergent compartment 5, illustrated in FIG. 6, with the lid 25 in an open position. As can be seen in FIG. 7, according to these embodiments, the opening 7 is formed at an upper portion 5' of the detergent compartment 5 by a displacement of the lid 25 towards the open position. The dishwasher may comprise an electronically controlled latch which may control the lid 25 to the open position in the beginning of a wash cycle. Furthermore, as can be seen in FIG. 5, the opening 7 is arranged such that it allows a flow of water from the two or more static nozzle openings through the opening 7 while it prevents a release of undissolved detergent out of the detergent compartment 5.

Figure 8:
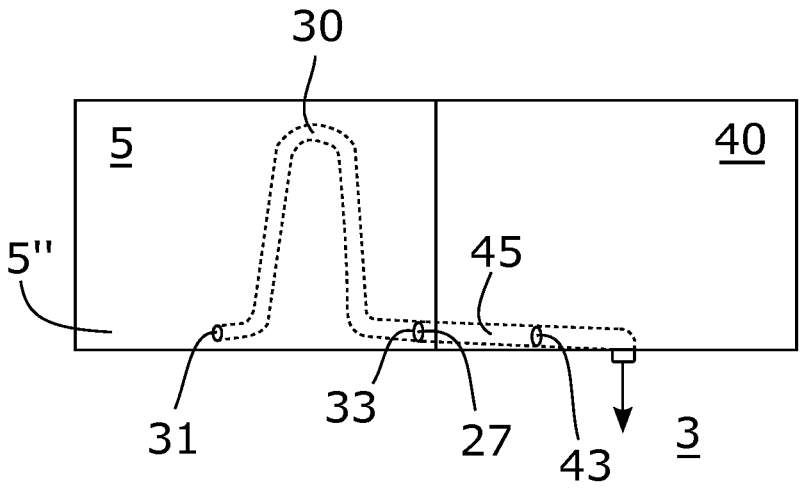

FIG. 8 schematically illustrates a front view a detergent compartment 5, according to some embodiments. The detergent compartment 5 comprises a detergent outlet 27 connected to a lower portion 5" of the detergent compartment 5. Moreover, the dishwasher 1 comprises a siphon 30 with an inlet 31 connected to the lower portion 5" of the detergent compartment 5 and an outlet 33 connected to the detergent outlet 27. Thereby, a detergent compartment 5 is provided which requires a certain fill level before liquid starts to flow out of the detergent outlet 27. Thereby, a user may fill the detergent compartment 5 with liquid detergent, and/or detergent powder, without the detergent flowing out of the detergent compartment 5. Furthermore, since the detergent compartment 5 requires a certain fill level before liquid starts to flow out of the detergent outlet 27, detergent in the detergent compartment 5 can be dissolved in a more efficient, quick, and reliable manner. This because when water is sprayed from the two or more static nozzle openings into the detergent compartment 5, the detergent may be surrounded by a turbulent flow of water.

According to the embodiments illustrated in FIG. 8, the dishwasher 1 further comprises a rinse aid compartment 40 adjacent to the detergent compartment 5. The rinse aid compartment 40 is configured to be filled with rinse aid. The rinse aid compartment 40 comprises a rinse aid outlet 43 for delivering rinse aid into the washing chamber 3. The rinse aid compartment 40 may comprise an electronically controlled valve which may be controlled to an open position towards the end of a wash cycle to deliver rinse aid into the washing chamber 3 through the rinse aid outlet 43. According to the illustrated embodiments, the detergent outlet 27 and the rinse aid outlet 43 are arranged in a shared liquid conducting path 45. Thereby, a more efficient, quick, and predictable delivering of rinse aid is provided into the washing chamber 3. This because water sprayed from the two or more static nozzle openings will flow through the shared liquid conducting path 45 and will thus clean the shared liquid conducting path 45 from rinse aid and rinse aid residues. Furthermore, the water sprayed from the two or more static nozzle openings will assist the rinse aid in reaching the sump of the dishwasher from which the rinse aid can be pumped to spray arms of the dishwasher.

Moreover, as can be seen in FIG. 8, the rinse aid outlet 43 is arranged downstream of the detergent outlet 27 in the shared liquid conducting path 45. As a result, water sprayed from the two or more static nozzle openings will flow over the rinse aid outlet 43 and will thus clean the rinse aid outlet 43 from rinse aid and rinse aid residues. Furthermore, according to the illustrated embodiments, the detergent outlet 27 is arranged at a higher position than the rinse aid outlet 43 relative the gravitational field at the location of the dishwasher, when the door is in the closed position and when the dishwasher is positioned in an upright use position. Thereby, due to gravity, the water flowing from the detergent outlet 27 will flow over the rinse aid outlet 43. According to the illustrated embodiments, the shared liquid conducting path 45 extents with an inclination relative a vertical plane and a horizontal plane such that water flowing through the shared liquid conducting path 45 flows in a direction having a component in the horizontal direction, which provides conditions for an efficient utilization of space. According to further embodiments of the present disclosure, detergent outlet 27 may be arranged substantially straight above the rinse aid outlet 43 and the shared liquid conducting path 45 may extend in a substantially vertical direction relative the gravitational field at the location of the dishwasher, when the door is in the closed position and when the dishwasher is positioned in an upright use position.

It is to be understood that the foregoing is illustrative of various example embodiments and that the invention is defined only by the appended claims. A person skilled in the art will realize that the example embodiments may be modified, and that different features of the example embodiments may be combined to create embodiments other than those described herein, without departing from the scope of the present invention, as defined by the appended claims.

The lower portion 5" of the detergent compartment 5 may herein be defined as a portion of the detergent compartment 5 below 30% of a height of the detergent compartment 5, measured in a direction coinciding with a direction of the gravitational field at the location of the dishwasher 1, when the door 23 is in the closed position and when the dishwasher is positioned in an upright use position.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A dishwasher comprising:

a washing chamber;

a detergent compartment comprising an opening facing the washing chamber; and one or more static nozzle openings arranged in the washing chamber, wherein the one or more static nozzle openings is configured to spray water into the detergent compartment, via the opening, during operation of the dishwasher, wherein the dishwasher comprises an upper spray arm and an upper hydraulic conduit arranged to feed water to the upper spray arm, and wherein the one or more static nozzle openings are fluidly connected to the upper hydraulic conduit.

2. The dishwasher according to claim 1, wherein the opening is located at an upper portion of the detergent compartment.

3. The dishwasher according to claim 1, wherein the one or more static nozzle openings are arranged on a wall of the washing chamber.

4. The dishwasher according to claim 3, wherein the wall is a roof of the washing chamber.

5. The dishwasher according to claim 1, wherein at least two of the one or more static nozzle openings are arranged such that liquid jets from the at least two static nozzle openings cross each other's paths between the at least two static nozzle openings and the detergent compartment.

6. The dishwasher according to claim 1, wherein the one or more static nozzle openings are arranged in one static nozzle unit.

7. The dishwasher according to claim 1, wherein the dishwasher comprises a door arranged to provide a closure of the washing chamber, and wherein the detergent compartment is arranged on the door.

8. The dishwasher according to claim 7, wherein the opening is arranged on an upper portion of the door.

9. The dishwasher according to claim 1, wherein the detergent compartment is displaceable between an open position and a closed position, and wherein the opening is formed at an upper portion of the detergent compartment by a displacement of the detergent compartment towards the open position.

10. The dishwasher according to claim 1, wherein the detergent compartment comprises a lid displaceable between an open position and a closed position, and wherein the opening is formed at an upper portion of the detergent compartment by a displacement of the lid towards the open position.

11. The dishwasher according to claim 1, wherein the detergent compartment comprises a detergent outlet connected to a lower portion of the detergent compartment.

12. The dishwasher according to claim 11, wherein the dishwasher comprises a siphon with an inlet connected to the lower portion of the detergent compartment and an outlet connected to the detergent outlet.

13. The dishwasher according to claim 11, wherein the dishwasher further comprises a rinse aid compartment comprising a rinse aid outlet for delivering rinse aid into the washing chamber, and wherein the detergent outlet and the rinse aid outlet are arranged in a shared liquid conducting path.

14. The dishwasher according to claim 13, wherein the rinse aid outlet is arranged downstream of the detergent outlet in the shared liquid conducting path.

15. A dishwasher comprising:

a washing chamber;

a detergent compartment comprising an opening facing the washing chamber; and one or more static nozzle openings arranged in the washing chamber, wherein the one or more static nozzle openings is configured to spray water into the detergent compartment, via the opening, during operation of the dishwasher, wherein the dishwasher comprises a rack for accommodating items to be washed in the washing chamber, and wherein the two-one or more static nozzle openings are arranged on the rack.

16. The dishwasher according to claim 15, wherein at least two of the one or more static nozzle openings are arranged such that liquid jets from the at least two static nozzle openings cross each other's paths between the at least two static nozzle openings and the detergent compartment.

17. The dishwasher according to claim 15, wherein the one or more static nozzle openings are arranged in one static nozzle unit.

18. The dishwasher according to claim 15, wherein the dishwasher comprises a door arranged to provide a closure of the washing chamber, and wherein the detergent compartment is arranged on the door.

19. A dishwasher comprising:

a washing chamber;

a detergent compartment comprising an opening facing the washing chamber;

a first static nozzle opening arranged in the washing chamber and configured to spray water directly through the opening and into the detergent compartment during operation of the dishwasher, wherein the dishwasher comprises an upper spray arm and an upper hydraulic conduit arranged to feed water to the upper spray arm, and wherein the first static nozzle opening is fluidly connected to the upper hydraulic conduit.

20. The dishwasher according to claim 19, wherein the opening is located at an upper portion of the detergent compartment, and the first static nozzle opening is arranged on a roof wall of the washing chamber.

21. The dishwasher according to claim 19, wherein the dishwasher comprises a door arranged to provide a closure of the washing chamber, and the detergent compartment is arranged on the door.

22. The dishwasher according to claim 21, wherein the first static nozzle opening is arranged at a front of a roof wall of the washing chamber and directed towards the opening.

23. The dishwasher according to claim 22, wherein the opening is arranged on an upper portion of the door.

24. The dishwasher according to claim 19, wherein the detergent compartment comprises a detergent outlet connected to a lower portion of the detergent compartment, and wherein the dishwasher comprises a siphon with an inlet connected to the lower portion of the detergent compartment and an outlet connected to the detergent outlet.

25. The dishwasher according to claim 19, further comprising a second static nozzle opening arranged in the washing chamber and configured to spray water directly through the opening and into the detergent compartment during operation of the dishwasher.

26. The dishwasher according to claim 25, wherein the first static nozzle opening and the second static nozzle opening are arranged in one static nozzle unit.

27. A dishwasher comprising:

a washing chamber;

a detergent compartment comprising an opening facing the washing chamber; a first static nozzle opening arranged in the washing chamber and configured to spray water directly through the opening and into the detergent compartment during operation of the dishwasher, wherein the dishwasher comprises a door arranged to provide a closure of the washing chamber, and the detergent compartment is arranged on the door, wherein the dishwasher comprises a rack for accommodating items to be washed in the washing chamber, and wherein the first static nozzle opening is arranged on the rack.

28. The dishwasher according to claim 27, wherein the first static nozzle opening is arranged on a side of the rack facing the door and directed towards the opening.

29. The dishwasher according to claim 27, further comprising a second static nozzle opening arranged in the washing chamber and configured to spray water directly through the opening and into the detergent compartment during operation of the dishwasher.

30. The dishwasher according to claim 29, wherein the first static nozzle opening and the second static nozzle opening are arranged in one static nozzle unit.

31. The dishwasher according to claim 27, wherein the dishwasher comprises a door arranged to provide a closure of the washing chamber, and the detergent compartment is arranged on the door.

* * * * *